US011635173B1

(12) United States Patent
Wang

(10) Patent No.: US 11,635,173 B1
(45) Date of Patent: Apr. 25, 2023

(54) WATERPROOF LIGHT BULB

(71) Applicant: DONGGUAN HUIHUAN LIGHTING CO., LTD, Dongguan (CN)

(72) Inventor: Song Wang, Chengdu (CN)

(73) Assignee: DONGGUAN HUIHUAN LIGHTING CO., LTD, Dongguan (CN)

( * ) Notice: Subject to any disclaimer, the term of this patent is extended or adjusted under 35 U.S.C. 154(b) by 0 days.

(21) Appl. No.: 17/855,828

(22) Filed: Jul. 1, 2022

(30) Foreign Application Priority Data

May 24, 2022 (CN) ..... 202221258087.9

(51) Int. Cl.

| | |
|---|---|
| ***F21K 9/232*** | (2016.01) |
| ***F21V 19/00*** | (2006.01) |
| ***F21V 31/00*** | (2006.01) |
| ***F21K 9/278*** | (2016.01) |
| *F21Y 115/10* | (2016.01) |

(52) U.S. Cl.
CPC ..... *F21K 9/232* (2016.08); *F21K 9/278* (2016.08); *F21V 19/0015* (2013.01); *F21V 31/005* (2013.01); *F21Y 2115/10* (2016.08)

(58) Field of Classification Search
CPC ..... F21K 9/232; F21K 9/278; F21V 31/005
See application file for complete search history.

(56) References Cited

U.S. PATENT DOCUMENTS 11,125,430 B1 * 9/2021 Wu ..... F21V 17/12
2019/0338891 A1 * 11/2019 Heil ..... F21V 23/001

* cited by examiner

*Primary Examiner* — Karabi Guharay

(57) ABSTRACT

The invention involves the technical field of light bulbs, disclosing a waterproof light bulb comprising a lamp head and a bulb connected, a soft glue lamp base and a resilient waterproof stein structure, which connects to the lamp head and extends into the bulb. The stein structure comprises a first metal lead, a LED strip and a second metal lead in sequential electrical connection. The first and second metal lead are integrated with a soft glue light base, and are electrically connected with the lamp head. The soft glue light base is sealed tightly fitted with inside of the bulb mouth; the invention's benefits include: 1. The bulb features a soft glue lamp base with waterproof sealing and enhanced waterproof properties; 2. The improved stein structure sets detents on the first and second metal lead that are encapsulated with the LED strip, with simplified process and lower production costs.

12 Claims, 4 Drawing Sheets

WATERPROOF LIGHT BULB

FIELD OF THE INVENTION

The present invention relates to the technical field of light bulbs, and in particular to a waterproof light bulb.

BACKGCIRCULAR OF THE INVENTION

Light bulbs are the primary light fixtures used for lighting, and as technology evolves, from traditional tungsten filament bulbs to current LED chip bulbs, LED bar bulbs, etc., a wide variety of light bulbs have become more common and widely used for lighting in industrial, home, mine, etc. environments.

In actual use, existing LED bulbs, particularly bulb structures employing LED strips, often suffer from water ingress within the bulb due to climate, environment, rain, and the like, causing damage to the LED strip, or from misting of these water vapors within the bulb, and the like, affecting use. Therefore, how to prevent water ingress inside the bulb of a light bulb becomes a key issue for light bulb fabrication. To solve the above problems, the inventors have made a new invention.

SUMMARY OF THE INVENTION

It is an object of the present invention to provide a waterproof light bulb, characterized by good waterproof properties against the defects of the prior art.

In order to achieve the above object, the invention is a waterproof light bulb, comprising a lamp head and a bulb connected to the lamp head, further comprising a soft glue lamp base and the stein structure having a resilient waterproof action, the stein structure is connected to the lamp head and extends into the bulb, the stein structure includes a first metal lead, an LED strip, and a second metal lead in sequential electrical connection, each of the first and second metal leads being integrally formed with the soft glue lamp base that is sealingly tightly fitted with the inside of the mouth of the bulb and each of the first and second metal leads being electrically connected with the lamp head.

Further, the LED strip is externally coated with an encapsulating layer, the encapsulating layer being an epoxy resin, a polyurethane modified epoxy resin, or a polyurethane resin.

Preferably, the first and second metal leads are each provided with detents for connecting the LED strip, the encapsulating layer integrally encapsulating the LED strip and detents.

Preferably, the lower end width of the first metal lead and second metal lead is greater than the upper end width.

Further, the stein structure further comprises a first resistor for preventing damage to the LED strip.

Preferably, the first resistor is provided at the first metal lead or the second metal lead, and the first resistor is located between the LED strip and the soft glue lamp base.

Preferably, the first resistor is integrated with the LED strip.

Preferably, the stein structure further comprises a second resistor.

Further, the first and second metal leads are circular or flat shaped.

Still further, the soft glue lamp base bottom is provided with a flange abutting against the mouth of the bulb.

Benefits: Compared to the prior art, the invention is a waterproof light bulb, comprising a lamp head and a bulb connected to the lamp head, further comprising a soft glue lamp base and a stein structure having a resilient waterproof action, the stein structure is connected to a lamp head and extends into a bulb, the stein structure comprising a first metal lead, an LED strip, and a second metal lead in sequential electrical connection, the first metal lead and the second metal lead each being integrally formed with the soft glue light base, the first metal lead and the second metal lead each being electrically connected with the lamp head, the soft glue light base being sealingly tightly fitted with the inside of the mouth of the bulb; the present invention has the following advantages: 1. The bulb is provided with the soft glue lamp base, with a waterproof sealing action, improving the waterproof properties of the bulb; 2. Improving the stein overall structure, the first and second metal leads being provided with detents which are encapsulated together with the LED strip, simplifying process flow and reducing production costs; 3. The lower end width of the first and second metal leads is greater than the upper end width, and the metal leads have better supporting effect while saving material.

Figure 1:
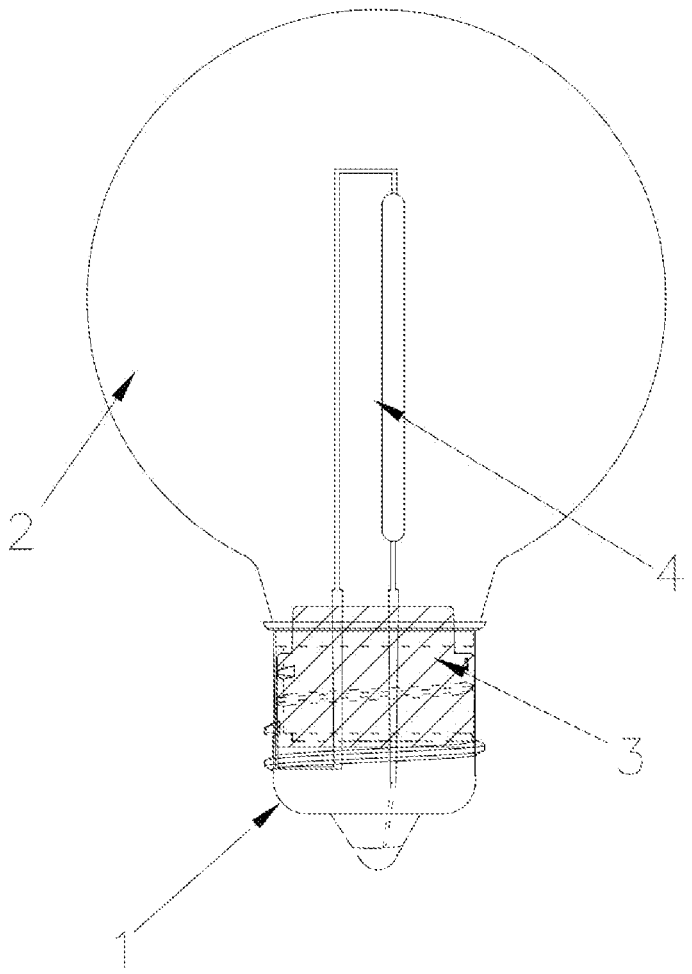
FIG. 1 is an overall perspective view of the present invention.

Reference Numbers Include:

Lamp head—1, bulb—2, soft glue lamp base—3, flange—31, stein structure—4, first metal lead—41, LED strip—42, second metal lead—43, encapsulating layer—44, detent—45, first resistor—46, second resistor—47.

DETAILED DESCRIPTION OF THE INVENTION

The invention will now be described in detail with reference to FIGS. 1 to 4.

The invention is a waterproof light bulb, comprising a lamp head 1 and a bulb 2 connected to the lamp head 1, further comprising a soft glue lamp base 3 and stein structure 4 with resilient waterproof action, the stein structure 4 is connected to the lamp head 1 and extends into the bulb 2, the stein structure 4 comprises a first metal lead 41, an LED strip 42 and a second metal lead 43 in sequential electrical connection, the first metal lead 41 and the second metal lead 43 each integrally formed with the soft glue lamp base 3 sealingly tightly fitted with the inside of the mouth of the bulb 2 and respectively electrically connected with the lamp head 1. The light bulb of the present invention is provided with the soft glue lamp base 3 to improve the waterproof properties of the light bulb, and at the same time the soft glue lamp base 3 is injection-molded directly with the first and second metal leads 41, 43, which is produced by simply placing the molded stein structure 4 directly in the respective arrangement and directly injection molding, the structure can be greatly simplified and the production process reduced. The soft glue lamp base 3 is mainly made of rubber or silicone material and has a certain elasticity to enhance the sealing effect.

In this technical solution, the LED strip 42 is externally coated with an encapsulating layer 44 that is an epoxy resin, a polyurethane modified epoxy resin, or a polyurethane resin. The LED strip 42 is a flexible light emitting panel that is externally coated with an encapsulating layer 44 that is coated with a resin, primarily epoxy, polyurethane modified epoxy, or polyurethane resin, which has the advantages of high temperature resistor, good toughness, non-irritating odor, and the like.

Preferably, the first and second metal leads 41, 43 are each provided with detents 45 for connecting the LED strip 42, the encapsulating layer 44 integrally encapsulating the LED strip 42 and the detents 45. The conventional stein structure 4 is typically only partially coated with the encapsulating layer 44 on the LED strip 42, and forming the stein structure 4 in such a way that the first and second metal leads 41, 43 are soldered to both ends of the LED strip 42, this forming approach tends to suffer from soldering difficulties due to the small volume of the light bar and metal leads, on the other hand, it is costly to manufacture by soldering, complicated process flow, and to overcome the above-mentioned problems, the inventors provide detents 45 on the metal wires to directly snap the light bar and encapsulate the snap-on site with the LED strip 42, provide further secure connection of the metal leads to the LED strip 42 for ease of assembly, and reduce production costs.

Figure 2:
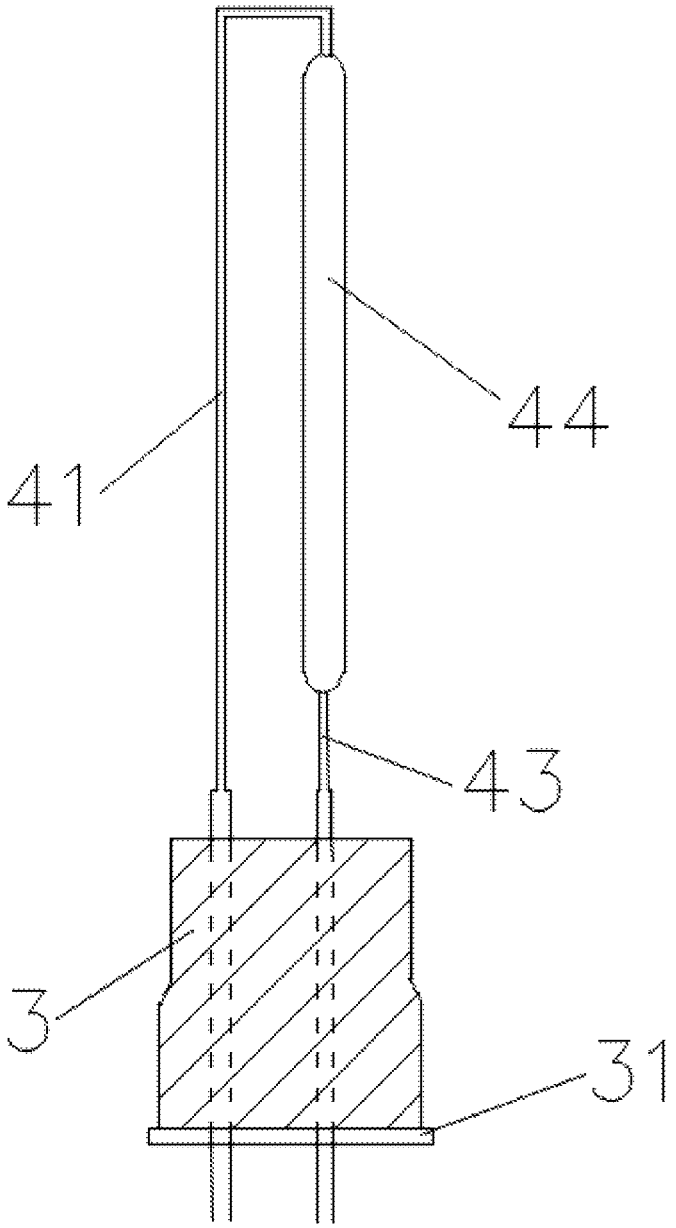
FIG. 2 is a schematic diagram of the structure of the soft glue lamp base of the present invention.
Figure 3:
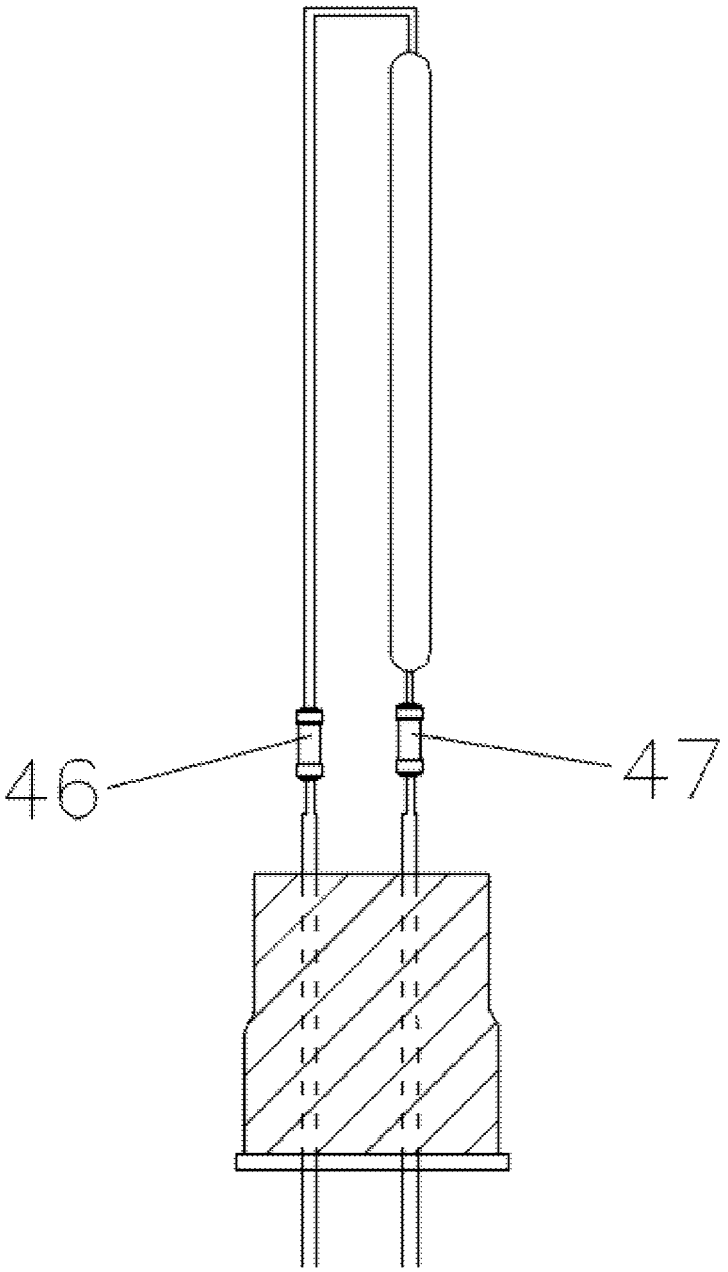
FIG. 3 is a schematic diagram of the structure of the first resistor and the second resistor of the present invention.
Figure 4:
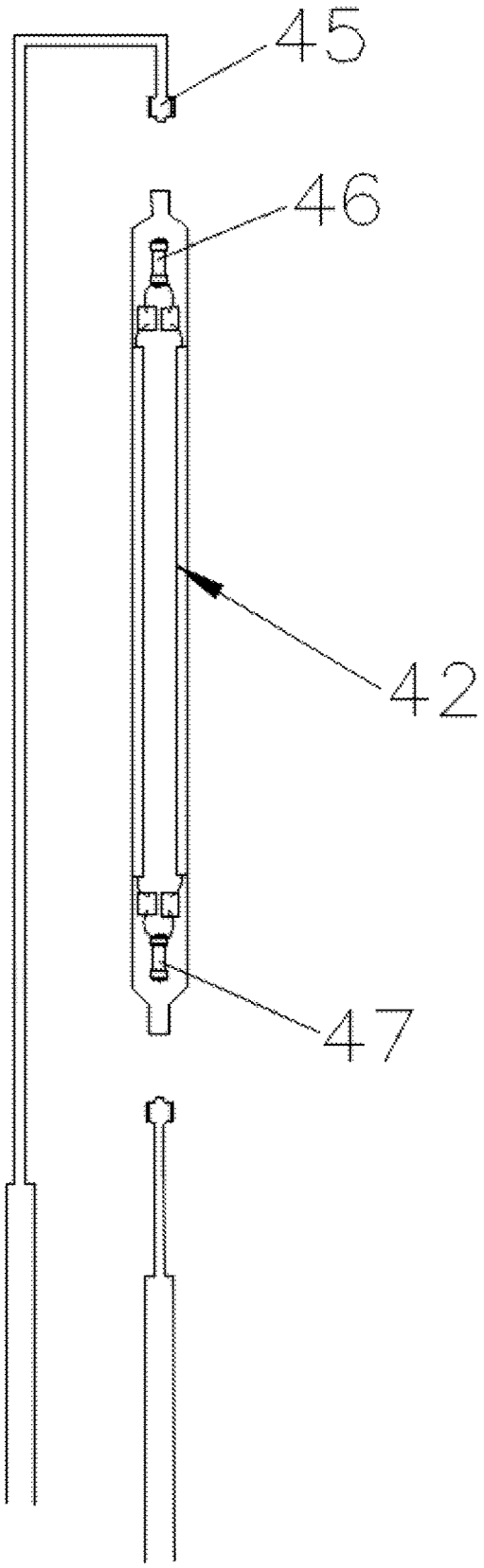
FIG. 4 is a schematic diagram of the stein structure of the present invention.

As shown in FIG. 2, the lower end width of the first and second metal leads 41, 43 is larger than the upper end width. When the size of the bulb is large, there is a corresponding need to fit a large stein structure 4, where the width of the lower end portion of the first and second metal leads 41, 43 is greater than the width of the upper end portion advantageously provides greater support for the metal leads to support the LED strip 42, preventing bending of the metal leads, and the smaller width of the upper end of the metal leads in turn guaranteeing the overall aesthetics of the bulb. In particular when the metal leads are flat wires, blocking of the illumination is reduced, with better light efficiency.

In the present solution, the stein structure 4 further comprises a first resistor 46 for preventing damage to the LED strip 42. When the light bulb of the present invention is less powerful, typically no more than 3 W, such a small power bulb may not need to be provided with a resistor, nor is the LED strip 42 damaged, and when the power is more than 3 W during in use, the first resistor 46 needs to be provided to prevent excessive current, damaging the light bulb, As an embodiment, the first resistor 46 is provided in either the first metal lead 41 or the second metal lead 43, and the first resistor 46 is located between the LED strip 42 and the soft glue lamp base 3. In this embodiment, since the invention employs metal leads integrally formed with the soft glue lamp base 3, the first resistor 46 in this embodiment is exposed to the soft glue lamp base 3 such that the first resistor 46 does not need to be squeezed by the injection pressure and is less prone to damage and the yield of the light bulb is higher during the molding process.

As another embodiment, the first resistor 46 is integrated with the LED strip 42. Thus, concealment of the resistors within the light bar 42 together is achieved, avoiding that the first resistor 46 is exposed to affect the overall aesthetics of the bulb.

Preferably, the stein structure 4 further comprises a second resistor 47. On the basis of the first resistor 46, the second resistor 47 can be added again, the second resistor 47 having a current limiting and heat dissipating effect. The location of the second resistor 47 may likewise be provided on the metal lead or LED strip 42.

In this invention, the first and second metal leads 41, 43 can be circular or flat, depending on actual needs, increasing the diversity of light bulbs to meet consumer needs.

As shown in FIG. 2, the soft glue lamp base 3 is provided at the bottom with a flange 31 abutting the mouth of the bulb 2. The flange 31 abuts against the bulb 2 mouth, further improving the bulb sealing effect.

The foregoing is merely preferred embodiments of the invention, and is not to be construed as limiting the invention in all respects of the detailed description and the scope of application to those skilled in the art, in light of the spirit of the present invention.

The invention claimed is:

1. A waterproof light bulb, comprising a lamp head (1) and a bulb (2) connected to the lamp head (1), characterized in that further comprising a soft glue lamp base (3) and a stem structure (4) with resilient waterproof action, the stem structure (4) is connected to the lamp head (1) and extends into the bulb (2), the stem structure (4) comprises a first metal lead (41), an LED strip (42) and a second metal lead (43) in sequential electrical connection, the first and second metal leads (41, 43) each being integrally formed with the soft glue lamp base (3) and respectively electrically connected with the lamp head (1), the soft glue lamp base (3) being sealingly tightly fitted with the inside of the mouth of the bulb (2);

the LED strip (42) is externally coated with an encapsulating layer (44), the encapsulating layer (44) being an epoxy resin, a polyurethane modified epoxy resin or a polyurethane resin;

the first metal lead (41) and second metal lead (43) are each provided with a detent (45) for connecting the LED strip (42), the encapsulating layer (44) integrally encapsulating the LED strip (42) and the detent (45).

2. The waterproof light bulb according to claim 1, characterized in that the lower end width of the first metal lead (41) and second metal lead (43) is greater than the upper end width.

3. The waterproof light bulb according to claim 1, characterized in that the stem structure (4) further comprises a first resistor (46) for preventing damage to the LED strip (42).

4. The waterproof light bulb according to claim 3, characterized in that the first resistor (46) is arranged at the first metal lead (41) or the second metal lead (43), and the first resistor (46) is located between the LED strip (42) and the soft glue lamp base (3).

5. The waterproof light bulb according to claim 3, characterized in that the first resistor (46) is integrated with the LED strip (42).

6. The waterproof light bulb according to claim 5, characterized in that the stem structure (4) further comprises a second resistor (47), and the first resistor (46) and the second resistor (47) are respectively disposed two opposite ends of the LED strip (42) along a longitudinal direction.

7. The waterproof light bulb according to claim 6, characterized in that the first resistor (46) and the second resistor (47) and the LED strip (42) are externally coated with the encapsulating layer (44).

8. The waterproof light bulb according to claim 1, characterized in that the stem structure (4) further comprises a second resistor (47).

9. The waterproof light bulb according to claim 8, characterized in that the second resistor (47) and the LED strip (42) are coaxially arranged.

10. The waterproof light bulb according to claim 8, characterized in that first metal lead (41) comprises a vertical section, the vertical section of the first metal lead (41) is parallel with the LED strip (42).

11. The waterproof light bulb according to claim 1, characterized in that the first and second metal leads (41, 43) are circular or flat shaped.

12. The waterproof light bulb according to claim 1, characterized in that the soft glue lamp base (3) bottom is provided with a flange (31) abutting the mouth of the bulb (2).

* * * * *